US005645494A

United States Patent [19]

Dionne et al.

[11] Patent Number: 5,645,494

[45] Date of Patent: Jul. 8, 1997

[54] INSTRUCTIONAL GOLF MAT

[76] Inventors: Thomas A. Dionne, 8806 Croydon Ave., Los Angeles, Calif. 90045; Douglas W. Bokath, 1016 E. Edie Way, Lancaster, Calif. 93535

[21] Appl. No.: 332,960

[22] Filed: Nov. 1, 1994

[51] Int. Cl.[6] ..... A63B 69/36

[52] U.S. Cl. ..... 473/278; 473/270

[58] Field of Search ..... 273/195 R, 195 A, 273/35 R, 187 R, 187 A, 187.1, 187.6, 202; 434/252; 473/278, 270, 279, 268, 266, 218

[56] References Cited

U.S. PATENT DOCUMENTS

| | | | |
|---|---|---|---|
| 2,124,123 | 7/1938 | Rosengarten | 273/195 A |
| 2,707,638 | 5/1955 | Marley | 273/195 R |
| 3,406,977 | 10/1968 | Voelkerding | 273/202 |
| 3,414,266 | 12/1968 | Mitchell | 273/195 A |
| 4,545,581 | 10/1985 | Williamson | 273/187 A |
| 4,630,828 | 12/1986 | Lovin | 273/195 R |
| 4,805,913 | 2/1989 | Bott | 273/187.1 |
| 4,915,387 | 4/1990 | Baxstrom | 273/187 A |
| 5,071,130 | 12/1991 | Shofner | 273/187 A |
| 5,156,398 | 10/1992 | Kibamoto | 273/195 A |

FOREIGN PATENT DOCUMENTS

| | | | |
|---|---|---|---|
| 8301202 | 4/1983 | WIPO | 273/195 R |

*Primary Examiner*—Steven B. Wong
*Attorney, Agent, or Firm*—Lyon & Lyon LLP

[57] ABSTRACT

An instructional golf mat which accommodates left and right-handed golfers, and which is useful for efficiently practicing the fundamentals of a golf swing including ball placement, foot position, golf club swing path and tee height is disclosed.

9 Claims, 9 Drawing Sheets

INSTRUCTIONAL GOLF MAT

1. FIELD OF THE INVENTION

The current invention relates generally to the field of golf, and more particularly to instructional aids for improving a golf swing.

2.BACKGROUND OF THE INVENTION

As the game of golf has evolved over the last several hundred years, so too have the equipment, strategies and techniques used to play golf. Indeed, current golfers are inundated with all sorts of advanced, high-tech golf clubs and other equipment which are all aimed at lowering a golfer's score. Throughout time however, the pursuit of a proper golf swing has remained central to the game of golf. Accordingly, the advanced equipment available today is of little use to the golfer unless the golfer's swing is fundamentally sound.

To improve a golfer's swing, varying techniques addressing golf swing fundamentals have been suggested. For example, volumes of books, videotapes and other instructional aides offering techniques aimed at improving the golfer's swing are all available today. However, these instructional aides are of little help unless the golfer is able to apply them so that the suggested techniques such as stance, ball positioning and golf club swing path may be practiced repeatedly and properly.

A common drawback of many current instructional aides is that they are too complicated or require the presence of a golf professional or other instructor. Another drawback is that many instructional aides do not lend themselves for use at a driving range or other similar facility at which many golfers practice their swings. A reason for this is that many such aides include multiple components which require too much time to set up, which are too complicated to quickly learn how to use or which may be easily misplaced. Such aides are unsuitable for use at locations such as busy public driving ranges that typically attract young or otherwise inexperienced golfers.

While many driving ranges typically provide golf mats from which the golfer hits golf balls, such golf mats typically do not provide sufficient or any instructional aides whatsoever to help the golfer efficiently practice his or her golf swing. Furthermore, many existing golf mats wear out rapidly when repeatedly used in busy public driving ranges, do not accommodate left-handed golfers and/or do not provide a variable-height tee for use with different tee shots. Still further, many existing golf mats do not allow a golfer to experiment with different aspects of the swing such as stance so as to optimize the swing's efficiency.

For example, U.S. Pat. No. 5,071,130 to Shofner discloses a grid pattern for ball placement. However, the numbers and letters outlining the ball placement area and which serve to develop a "mental impression" of correct ball placement represent a complex manner in which to practice a golf swing that may distract the golfer. These indicia also do not aide in determining proper golf club swing path and Shofner's grid pattern does not include adequate reference points to allow the golfer to quickly position his or her feet and/or golf ball at the desired location. Furthermore, the Shofner mat has only one hitting area for both left and right-handed golfers which increases mat wear and decreases mat life. Shofner also does not include a tee which limits its use to irons and fairway woods.

As another example, U.S. Pat. No. 4,805,913 to Bott discloses a mat having a grid pattern to which foot silhouettes are removably attached at desired stances. That the silhouettes must be repeatedly attached and removed for the various stances associated with different golf shots may consume too much time of a golfer's practice session, or may be too complicated for young or inexperienced golfers. Separable silhouettes may also be misplaced when repeatedly used by different individuals at a public driving range. The Bott mat also has no tee nor reference points to allow quick stance positioning, and exhibits only one swing path line which prevents the golfer from incrementally changing the ball position. The Bott mat is also suitable only for right-handed golfers and includes a swing path extension requiring excessive space that may render it unsuitable for many public driving ranges under space constraints.

Other existing instructional golf mats are disclosed in U.S. Pat. Nos. 5,163,686 to Bergman, 5,042,815 to Sutton, 4,355,810 to Rydeck, 4,248,431 to Burnes, 4,164,352 to O'Brien, and 4,000,905 to Shirhall. However, the mats disclosed therein are all limited to single hitting areas for both left and right-handed golfers which as described above, reduces the life of the golf mat. These mats generally do not provide safety features, and in fact, several include features protruding from the mat which if struck by the golfer, could cause injury.

Accordingly, there is a need for an instructional golf mat or system which allows a golfer to efficiently and properly practice the golf swing, which is suitable for use at a public facility and which generally overcomes the foregoing problems.

3. SUMMARY OF THE INVENTION

The current invention is directed to a convenient and economical instructional aide for practicing golf swing fundamentals to obtain a consistent golf swing for improved golfing performance.

4. BRIEF DESCRIPTION OF THE DRAWINGS

FIG. 1 is a top view of an instructional golf mat.

FIG. 2*a* is a section view of an instructional golf mat.

FIG. 2*b* is an enlarged section view of a portion of an instructional golf mat.

FIG. 2*c* is an enlarged section view of a portion of a base.

FIGS. 3*a*–3*d* are top views of an instructional golf mat with a portion of a grid pattern removed to depict multiple hitting locations.

FIGS. 4*a*–4*b* are top views of an instructional golf mat with a portion of a grid pattern removed to depict hitting locations for left and right-handed golfers.

5. DETAILED DESCRIPTION OF THE PREFERRED EMBODIMENTS

Figure 1:
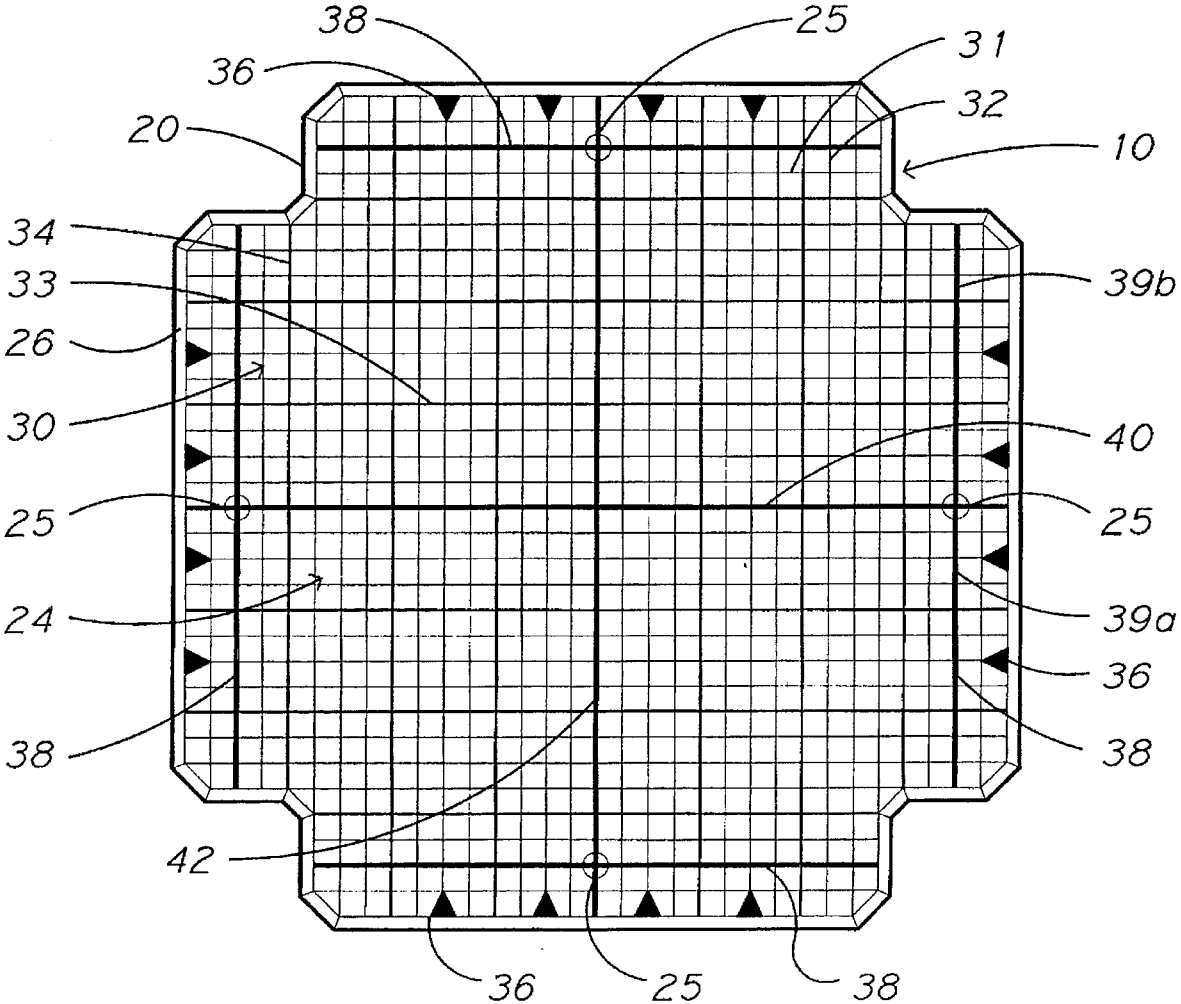
Figure 2A:
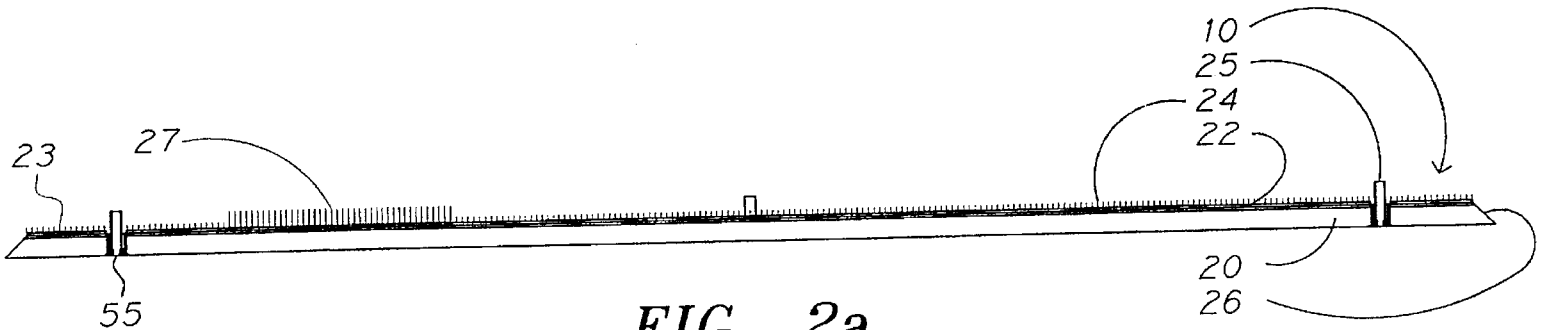
Figure 2B:
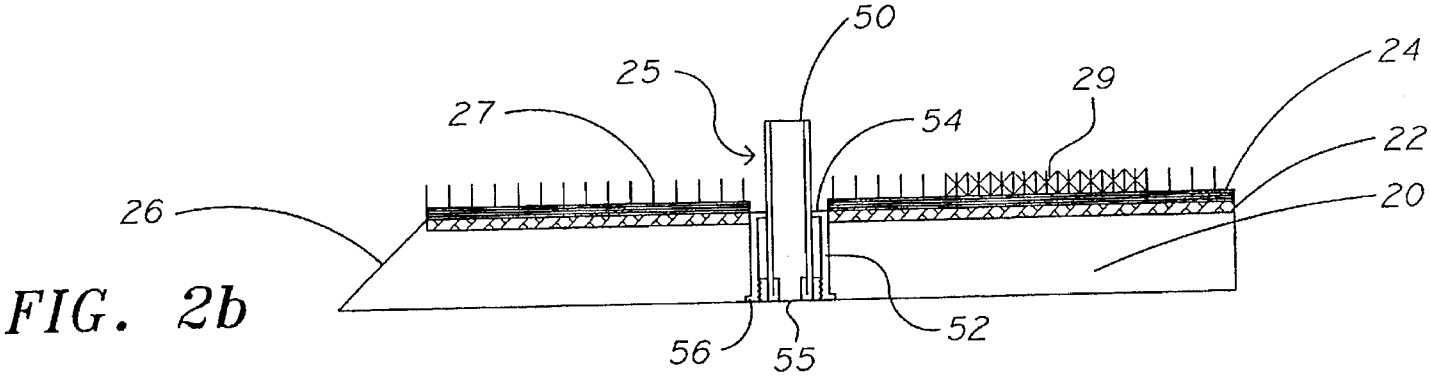

Referring to FIGS. 1, 2*a* and 2*b*, a preferred embodiment of an instructional golf mat 10 is described. As shown more clearly in FIGS. 2*a* and 2*b*, golf mat 10 may generally comprise a plurality of layers including a base 20, center layer 22 and top surface 24. Base 20 may include a beveled edge 26 which reduces the risk of a golfer tripping when stepping onto mat 10 which might otherwise occur since many golfers wear spiked shoes. Preferably, beveled edge 26 extends about the periphery of base 20 as shown in FIG. 1.

Base 20 preferably comprises a pliable material such as sheet rubber or recycled tires or other rubber molded into sheet form. The flexibility of such a material facilitates delivery to and placement of mat 10 at the driving range or other location at which it will be used. Preferably, the material comprising base 20 allows mat 10 to be rolled up during transport and also provides that it lay flat upon or shortly after placing the mat 10 at the desired location it will be used.

Figure 2C:
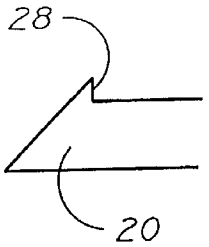

Base 20 preferably includes recess 28 adjacent to beveled edge 26 as shown in FIG. 2*c* so that center layer 22 and/or top surface 24 fit snugly therein without being permanently attached to base 20. This provides that the existing base 20 may still be used even if center layer 22 and/or top surface 24 need replacement. Alternatively, center layer 22 and top surface 24 may be mounted on top of base 10 and attached thereto with a suitable adhesive or other fastener.

Center layer 22 preferably serves a shock absorbing function to simulate the "giving" nature typical of a golf course fairway or rough, and to provide golfer comfort and safety. That is, should the golfer inadvertently swing the club so that it hits mat 10 with exorbitant force, i.e., significantly more force than associated with a typical divot, center layer 22 will absorb some amount of the resulting shock and may help reduce injury to the golfer's hands, wrist, forearms and/or elbows. This protection is beneficial given the high repetition in which a golfer may practice his or her swing on mat 10 in a given practice session, and/or the fact that young or otherwise inexperienced golfers may be using mat 10.

The shock-absorbing nature of center layer 22 also preferably extends the life of top surface 24 by providing a cushioning effect for the blows that may be delivered to top surface 24 by a golf club. This cushioning effect also preferably reduces or avoids cuts in top surface 24 that may be caused by golf clubs, especially irons. Accordingly, center layer 22 preferably serves a safety feature, as well as a preservation feature for top surface 24. Suitable materials for center layer 22 include a compressible material such as recycled rubber or padding used for carpeting or artificial playing fields.

Top surface 24 preferably includes an artificial turf surface or other material simulating grass on a golf course, and which is not easily cut by irons or other golf clubs. An example of a suitable material is ASTROTURF manufactured by Astroturf, Inc. The material comprising top surface 24 may also include vertical fibers 23 such as those included in ASTROTURF. The fibers 23 of top surface 24 may vary in length 27 between different portions of top surface 24 to simulate fairway or rough conditions all on the same mat 10. Top surface 24 may also include a portion 29 comprising a material simulating sand for practicing sand trap shots. For example, a portion 29 of top surface 24 may comprise a brush type material into which a golf ball may sink when placed thereon. Alternatively, a sand trap simulation device comprising a series of woven netting layers such as that manufactured by Par Buster may be attached to mat 10. Alternatively, a portion of mat 10 may be recessed and filled with sand. For example, top surface 24, center layer 22 and base 20 may all include corresponding holes filled with sand for foot and ball placement. Top surface 24 also preferably includes a plurality of tee locations 25 and a grid pattern 30 as described below.

Referring to FIG. 1, grid pattern 30 may be sprayed, laminated or otherwise imprinted onto top surface 24. Grid pattern 30 may include horizontal lines 31, vertical lines 32, horizontal reference lines 33, vertical reference lines 34, perimeter reference arrows 36, highlighted swing path lines 38, highlighted horizontal center line 40 and highlighted vertical center line 42.

Horizontal and vertical lines 31,32 form a pattern of squares which can be used to adjust the ball placement and foot positions in precise increments according to the type of club and shot being practiced. To this end, lines 31,32 may aid the golfer to precisely adjust his or her stance for "open" or "closed" stance shots used to intentionally slice or hook the golf ball. Alternatively, lines 31,32 also aid the golfer maintain a stance parallel to the direction of ball travel. A golfer may also use a column of the squares formed by lines 31,32 as a golf club swing path line to gauge whether the club is following a proper line of travel.

Grid pattern 30 may also be divided into larger squares by horizontal and vertical reference lines 33,34 which may act as references for foot stance, ball placement and swing path lines. Preferably, reference lines 33,34 are highlighted or otherwise bolder than lines 31,32 to help the golfer quickly identify his or her general location in relation to the more precise lines 31,32 so that the golfer may quickly assume the desired stance.

Grid pattern 30 may be further divided into four (4) sections by highlighted horizontal and vertical center lines 40, 42. The highlighting of lines 40,42 may be equal to that of lines 33,34 or even bolder. Center lines 40,42 serve several functions. First, they may serve as further stance alignment reference points so that the golfer may quickly identify his or her location with respect to the more precise reference lines 33,34 and lines 31,32 so that the golfer may quickly assume the desired stance.

Figure 4A:
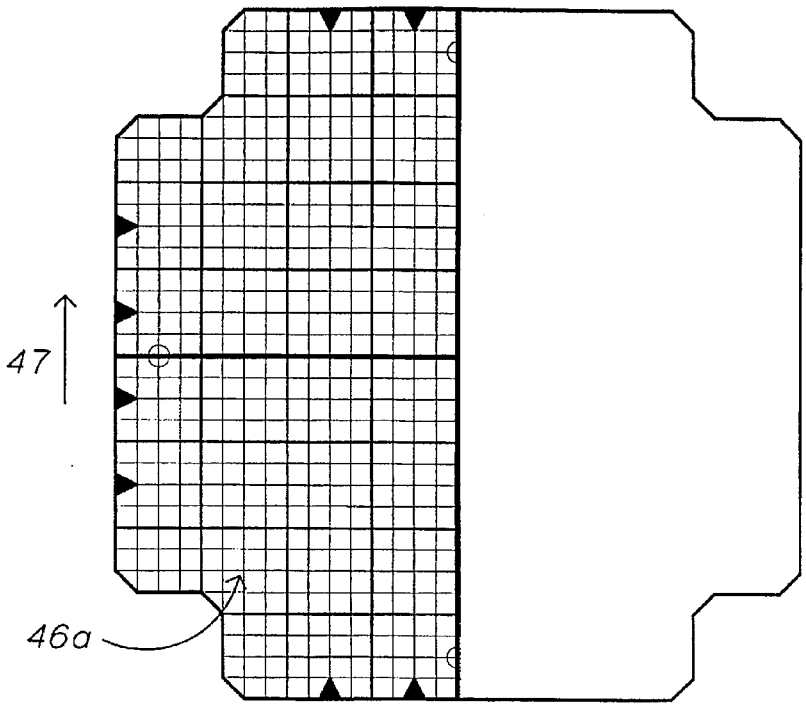
Figure 4B:
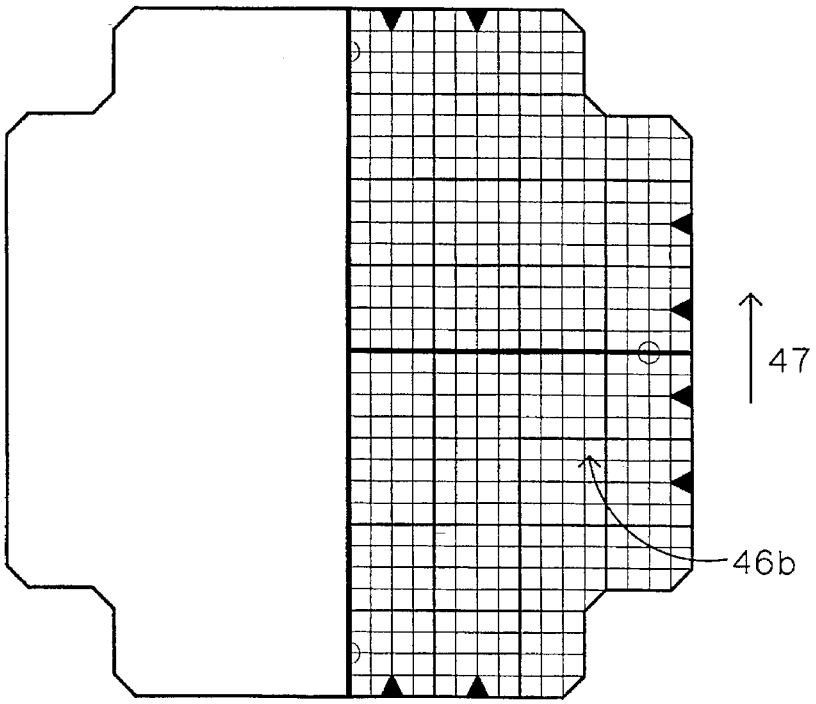

Second, center lines 40,42 may serve to divide top surface 24 into two hitting areas 46*a,b* for hitting in target direction 47 as shown in FIGS. 4*a* and 4*b* to accommodate left and right-handed golfers. Because top surface 24 preferably includes separate left and right-handed hitting areas 46*a,b*, the life of mat 10 will be prolonged because one common area will not become worn out by both left and right-handed golfers. Furthermore, a left or right-handed golfer may step right onto mat 10 to practice without having to rotate or otherwise adjust the placement of mat 10.

Figure 3A:
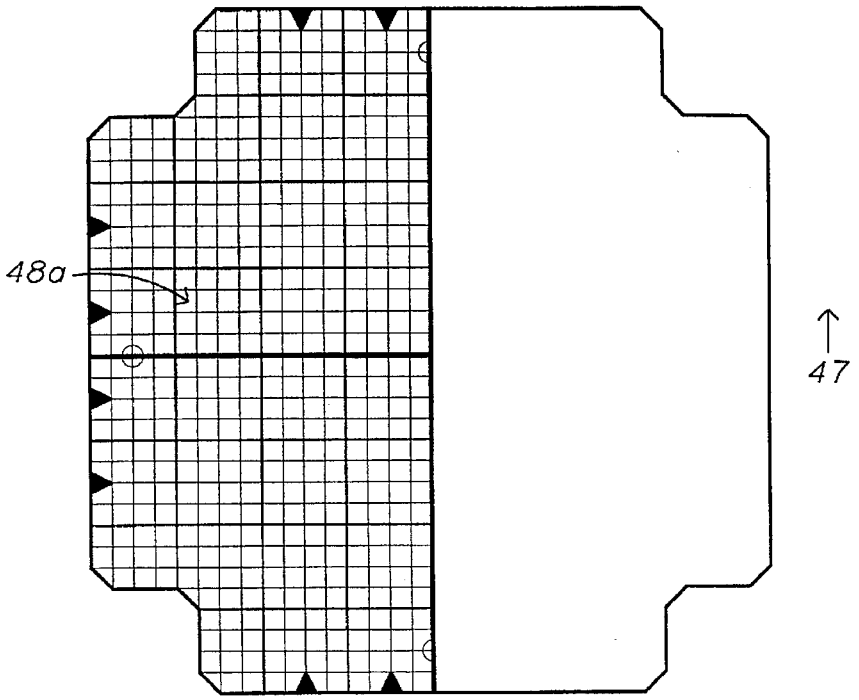
Figure 3B:
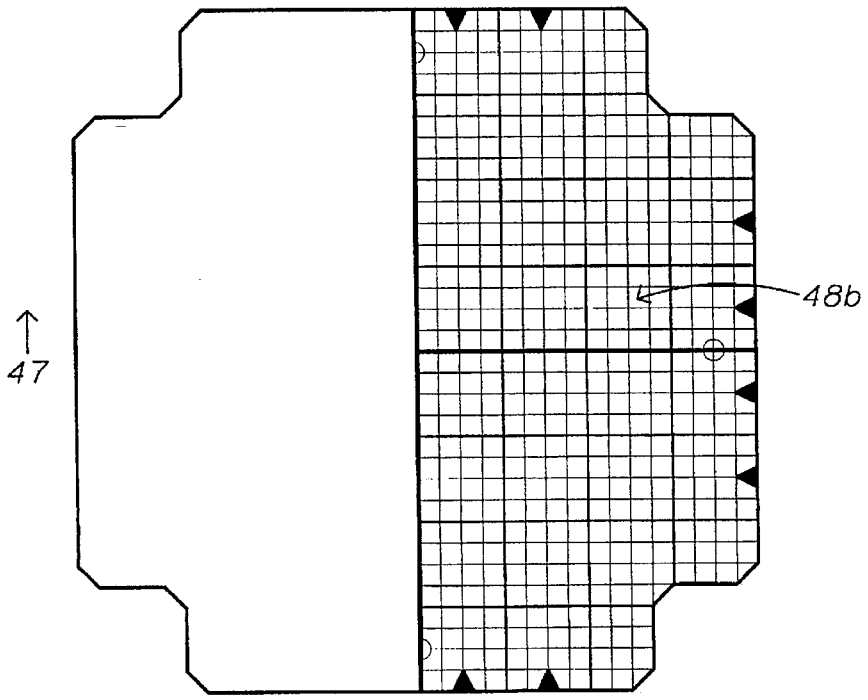
Figure 3C:
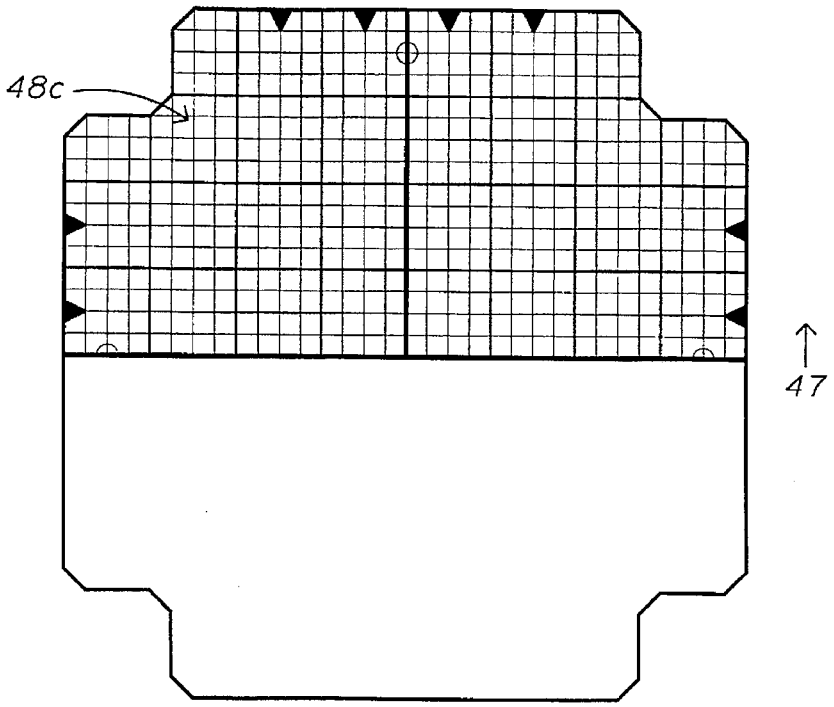
Figure 3D:
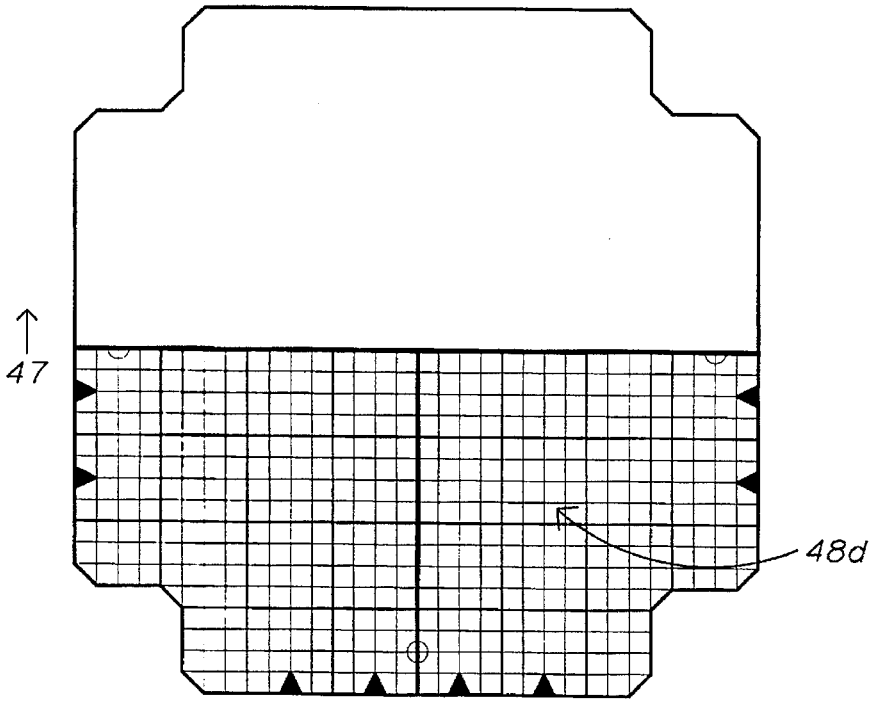

Third, center lines 40,42 may divide top surface 24 into four (4) hitting areas 48*a–d* as shown in FIGS. 3*a–*3*d*. That is, by rotating mat 10, ninety (90) degrees, two (2) additional hitting areas are available. Typically for example, mat 10 will be positioned initially such that area 48*a* will be used by left-handed golfers and area 48*b* will be used by right-handed golfers to shoot in target direction 47. When areas 48*a,b* become worn, mat 10 may be rotated ninety (90) degrees so that fresh areas 48*c,d* may then be used. Also, because there are many more right-handed than left-handed golfers, mat 10 may be rotated one hundred eighty (180) degrees so that an area previously devoted to left-handed golfers may then be devoted to right-handed golfers. Accordingly, multiple hitting areas are possible which serves to increase the life of top surface 24 and of mat 10.

Grid pattern 30 may also include perimeter reference arrows 36 which may serve as reference points for foot stance and ball placement. Preferably, perimeter reference arrows 36 are located so that they divide the larger highlighted squares defined by reference lines 33,34 into two (2) equal sections thereby providing reference points equidistant to the highlighted horizontal and vertical reference lines 33,34. This in turn allows the golfer to quickly identify and assume the desired stance and ball placement with respect to the horizontal and vertical reference lines 33,34 and the more precise lines 31,32.

Highlighted horizontal and vertical swing path lines 38 may be located two grid squares from the edge of top surface 24. Lines 38 are preferably parallel to the corresponding horizontal or vertical lines 31,32, reference lines 33,34 and center lines 40,42, as well as in line with a tee location 25. The parallel relationship between swing path lines 38 to the other lines of grid pattern 30 assures that a golfer's stance is square to the intended direction of the ball.

Swing path lines 38 preferably extend a significant length of a side of top surface 24 so that the golfer may gauge the direction of the club's swing path for a sufficient portion of the swing. This allows, for example, a right-handed golfer to bring the clubhead back along swing path line 38, and then swing the club first through point 39*a*, through the ball and then through point 39*b* to ensure that the club swing path is in line with the intended direction of the ball. Alternatively, swing path lines 38 allow the golfer to practice hook and slice shots by gauging whether the clubhead is outside or inside of the line 38 before and after hitting the ball.

Referring now to FIGS. 1, 2*a*, 2*b* and 5, the adjustable tee feature of the current invention is described. Preferably, mat 10 includes four (4) adjustable tee locations 25, each along a swing path line 38, along either center lines 40 or 42 and within each of the hitting areas 48*a–d*. This provides that tee locations 25 are integrated into grid pattern 30 so that the golfer may practice tee shots while varying his or her stance as desired.

Figure 5:
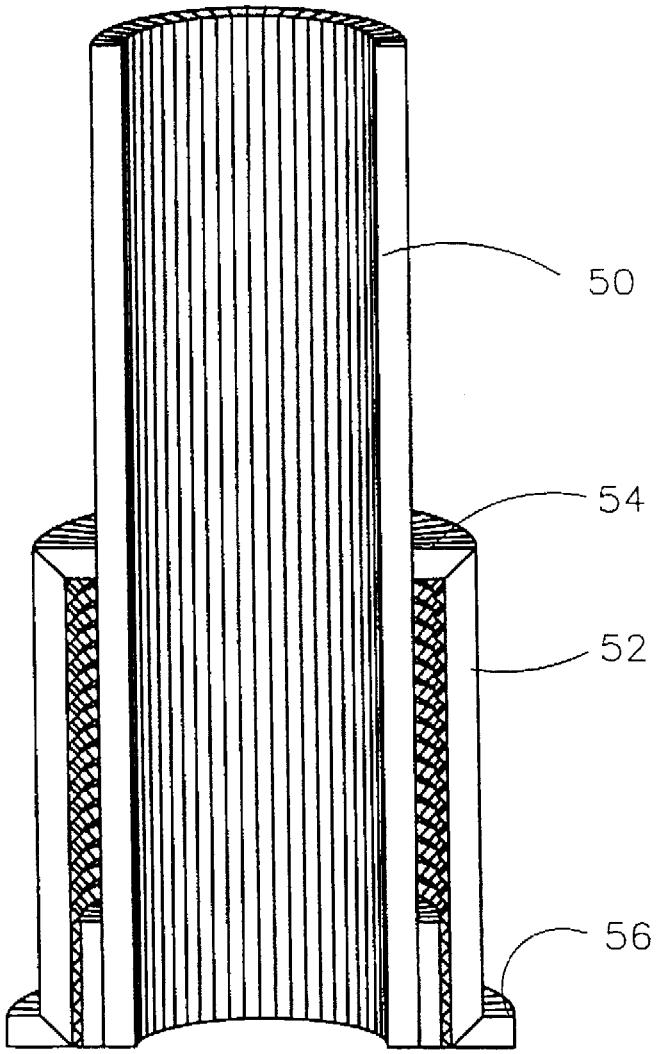
FIG. 5 is a cross-sectional view of an adjustable golf tee.

As shown in FIGS. 2*b* and 5, each tee may include a tee section 50 which may comprise a rubber tube and which serves to hold the ball, and a collar 52 which may also comprise a rubber material and which secures tee section 50 to mat 10. Tee section 50 and collar 52 may threadably engage each other or be press fitted, and preferably provide vertical tee adjustment so that the golfer may screw or pull/push tee section 50 up or down relative to collar 52 to practice tee shots with the tee at various heights. This in turn allows the golfer to experiment with various tee heights for various clubs to determine which is optimum. This is beneficial because wood shots are typically hit with higher tees while the tee is typically lowered for iron shots.

As shown in FIG. 2*b*, base 20, center layer 22 and top surface 24 may include a hole 55 at each tee location 25 having an inner diameter which approximately equals the outer diameter of collar 52. Tee section 50 and collar 52 may be fitted in hole 55 and collar 52 may be glued to the walls of hole 55 by any suitable industrial adhesive.

As shown in FIG. 5, collar 52 may include a lip 54 on its top edge to prevent tee section 50 from being completely removed through the top of collar 52. As shown in FIGS. 2*b* and 5, lip 56 of collar 52 prevents collar 52 from being pulled through the top of mat 10.

Figure 6:
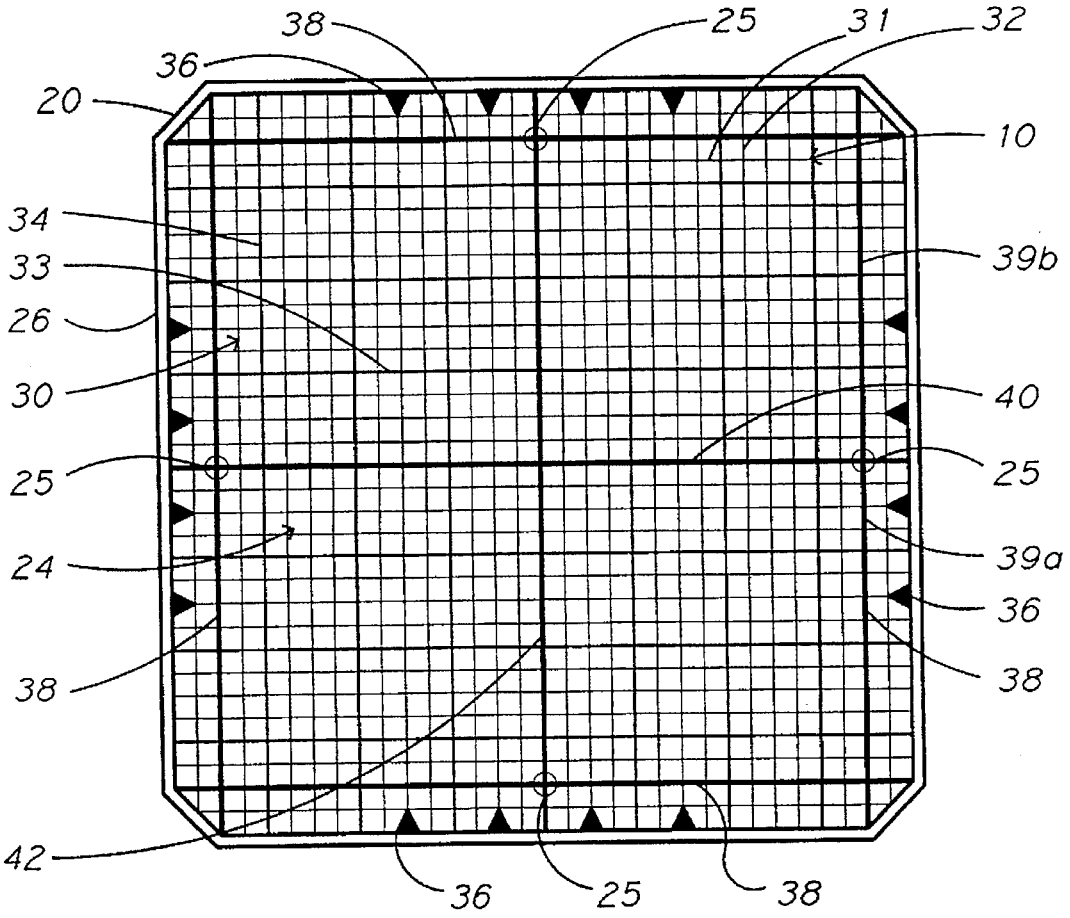
FIG. 6 is a top view of an instructional golf mat.
Figure 7:
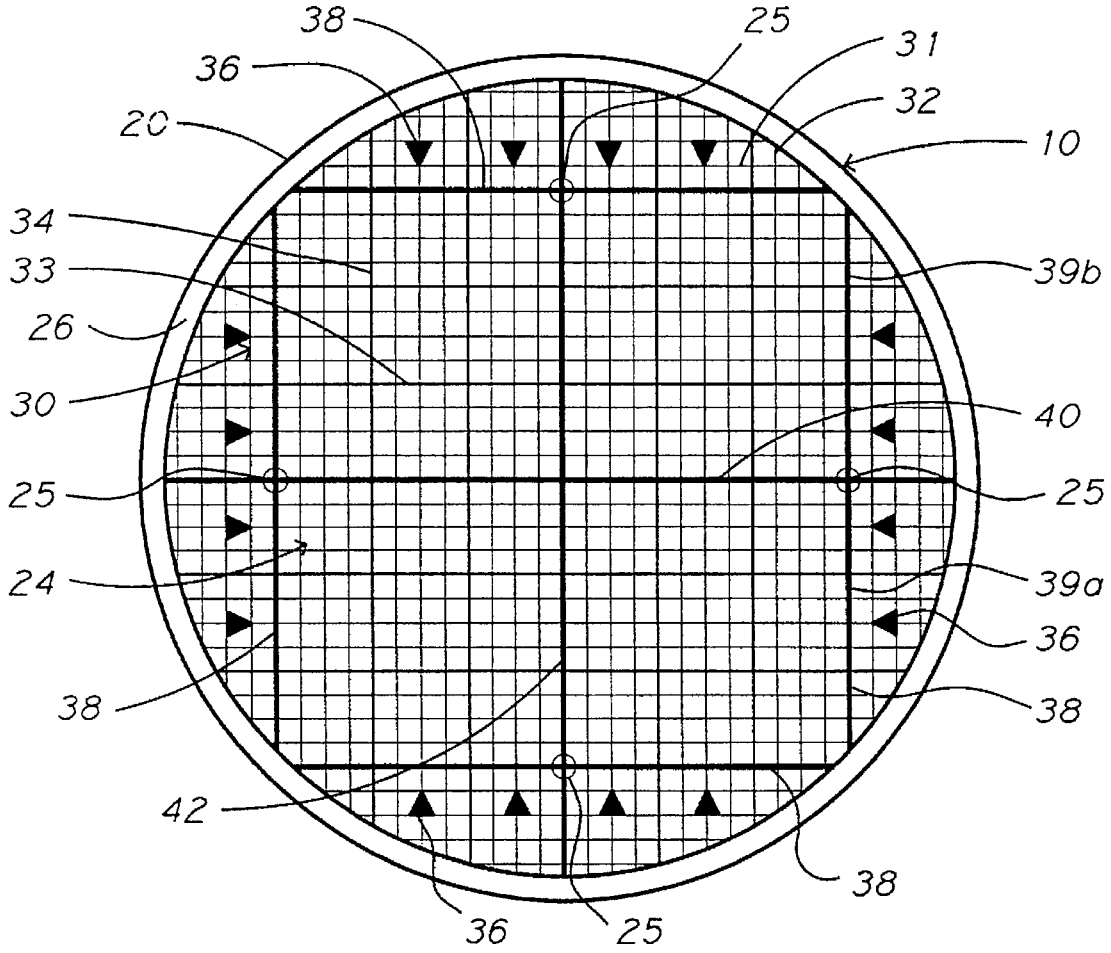
FIG. 7 is a top view of an instructional golf mat.
Figure 8:
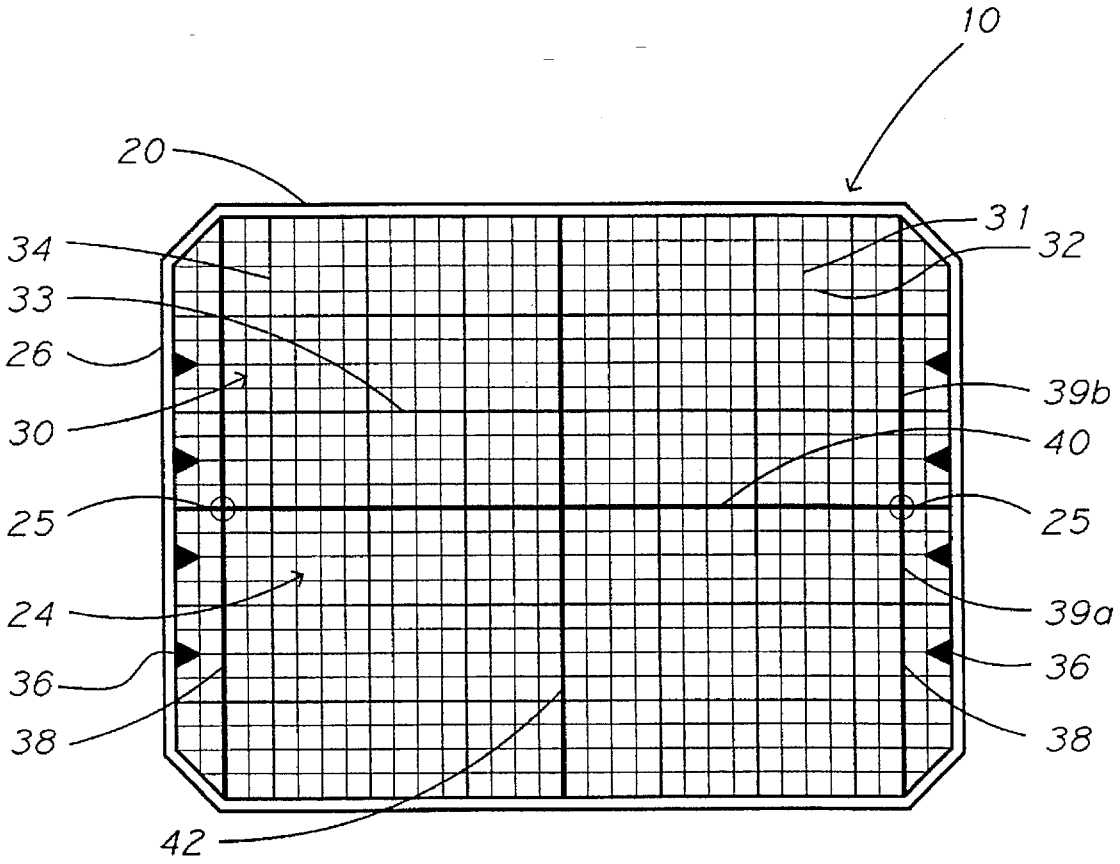
FIG. 8 is a top view of an instructional golf mat.

Though one shape of mat 10 has been shown in FIG. 1, mat 10 may have different configurations and still offer the same instructional aides as shown in FIGS. 6–8 in which components similar to those shown in FIG. 1 are similarly numbered. For example, mat 10 may be square as shown in FIG. 6, round as shown in FIG. 7 or rectangular as shown in FIG. 8. FIG. 8 also shows an embodiment including only two hitting stations. Furthermore, gird pattern 30 may be set forth in various increments such as one-half, one or two inches between lines 31,32. Perimeter reference arrows 36 may be of different colors or at various locations as may each of the different types of lines discussed above.

Accordingly, it will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. An instructional golf mat, comprising:

a base; and a top surface mounted to the base and including, a first grid pattern comprising a plurality of intersecting lines at which a golfer may relatively position his or her feet and a ball, the grid pattern extending over substantially the entire top surface between the feet and ball positions, a second grid pattern located within the first grid pattern and at which a golfer may relatively position his or her feet and a ball, the second grid pattern comprising selected intersecting lines of the first grid pattern which are uniformly-spaced and which are highlighted in relation to other of the lines of the first grid pattern, the second grid pattern extending over substantially the entire top surface between the feet and ball positions, at least two hitting stations located at respective regions of the top surface, each hitting station being defined by a third grid pattern comprising highlighted intersecting lines, and a plurality of golf club swing paths at each hitting station, the golf club swing paths being defined by the first and second grid patterns.

2. The instructional golf mat of claim 1, further comprising a center layer positioned between the base and the top surface, the center layer comprising a shock-absorbing material.

3. The instructional golf mat of claim 1, wherein the top surface further includes perimeter reference arrows located about the periphery of the top surface.

4. The instructional golf mat of claim 1, further comprising at least one tee located within the grid pattern.

5. The instructional golf mat of claim 4 wherein the at least one tee is adjustable in height.

6. The instructional golf mat of claim 5 wherein the at least one tee further comprises a collar positioned below the top surface and a tee section engaged to the collar.

7. The instructional golf mat of claim 6 wherein the collar and tee section are threadably engaged.

8. The instructional golf mat of claim 1, the top surface further comprising vertical fibers the length of which vary between portions of the top surface to simulate fairway and rough.

9. The instructional golf mat of claim 1, wherein a portion of the top surface comprises a material simulating sand.

* * * * *